US008592114B2

(12) United States Patent
Sakoh

(10) Patent No.: US 8,592,114 B2
(45) Date of Patent: Nov. 26, 2013

(54) TONER FOR DEVELOPING ELECTROSTATIC IMAGES

(75) Inventor: Yukinori Sakoh, Tokyo (JP)

(73) Assignee: Zeon Corporation, Tokyo (JP)

( * ) Notice: Subject to any disclaimer, the term of this patent is extended or adjusted under 35 U.S.C. 154(b) by 41 days.

(21) Appl. No.: 13/262,007

(22) PCT Filed: Mar. 29, 2010

(86) PCT No.: PCT/JP2010/055560
§ 371 (c)(1),
(2), (4) Date: Dec. 13, 2011

(87) PCT Pub. No.: WO2010/113870
PCT Pub. Date: Oct. 7, 2010

(65) Prior Publication Data

US 2012/0094230 A1 Apr. 19, 2012

(30) Foreign Application Priority Data

Apr. 1, 2009 (JP) ..... 2009-089048

(51) Int. Cl.
*G03G 9/08* (2006.01)

(52) U.S. Cl.
USPC ..... 430/108.1; 430/108.3; 430/108.7

(58) Field of Classification Search
USPC ..... 430/108.1, 108.3, 108.7
See application file for complete search history.

(56) References Cited

U.S. PATENT DOCUMENTS

| | | | |
|---|---|---|---|
| 2003/0134217 | A1 | 7/2003 | Combes et al. |
| 2010/0173241 | A1 | 7/2010 | Ieda |

FOREIGN PATENT DOCUMENTS

| | | | |
|---|---|---|---|
| JP | 8-076406 | A | 3/1996 |
| JP | 2000-019773 | A | 1/2000 |
| JP | 2003-215837 | A | 7/2003 |
| JP | 2004-231498 | A | 8/2004 |
| JP | 2007-099582 | A | 4/2007 |
| WO | 2008/146881 | A1 | 12/2008 |

OTHER PUBLICATIONS

International Search Report of PCT/JP2010/055560, date of mailing May 25, 2010.

*Primary Examiner* — Mark A Chapman
(74) *Attorney, Agent, or Firm* — Westerman, Hattori, Daniels & Adrian, LLP

(57) ABSTRACT

The present invention is to provide a toner for developing electrostatic images, comprising external additive A, external additive B, and colored resin particles comprising a binder resin and a colorant, wherein external additive A is fatty acid metal salt particles, and a content of the fatty acid metal salt particles is in the range from 0.01 to 0.5 part by weight with respect to 100 parts by weight of the colored resin particles, and wherein external additive B is spherical colloidal silica particles having a number average primary particle diameter of 30 to 80 nm and being surface-treated with a silane compound having an alkyl group of 8 to 20 carbons, and a content of the spherical colloidal silica particles is in the range from 0.3 to 2.0 parts by weight with respect to 100 parts by weight of the colored resin particles.

7 Claims, No Drawings

TONER FOR DEVELOPING ELECTROSTATIC IMAGES

TECHNICAL FIELD

The present invention relates to a toner for developing electrostatic images (hereinafter, it may be simply referred to as "toner") used for development of latent electrostatic images in electrophotography, the electrostatic recording method, the electrostatic printing process or the like. Particularly, the present invention relates to a toner for developing electrostatic images having excellent initial printing performance and printing durability under a severe usage environment such as high temperature and high humidity (H/H).

BACKGROUND ART

In image-forming devices such as electrophotographic devices, electrostatic recording devices, electrostatic printing devices and so on, a method of forming a desired image by developing an electrostatic latent image formed on a photosensitive member with a toner is widely employed. Such a method is applied to copying machines, printers, facsimile machines, multi function products thereof and so on.

For example, generally an electrophotographic device using electrophotography uniformly charges the surface of a photosensitive member formed of photoconductive material with any of various means, and then, an electrostatic latent image is formed on the photosensitive member. Next, the electrostatic latent image is developed using a toner. After transferring an image of the toner on a recording material such as paper or the like, the image of the toner is fixed by heating or the like. Thus, a copy is obtained.

As toners used for the image forming device, toners, in which external additives such as inorganic particles and organic particles having smaller particle diameter than that of colored resin particles (toner particles) are attached (externally added) on the surface of the toner particles, are generally used for the purpose of improving functions such as charging ability and flowability of the toner, thereby obtaining desired printing performance.

However, if the toner using a conventional external additive is used, charge change is more likely to occur when initial printing is performed under a severe environment such as high temperature and high humidity (H/H), compared to the case where the initial printing is performed under a normal temperature and normal humidity environment (N/N), and a function of the external additive (a function to impart charge stability and flowability to the toner) cannot be maintained. Therefore, it has been problems that an initial charging speed decreases, a deterioration in image quality due to initial fog or the like occurs, and adverse effect on initial printing performance is caused.

In addition, in the process of continuous printing of a large number of prints, defects such that particles of the external additive are buried on and/or released (detached) from the surface of toner particles are likely to occur due to mechanical stress (increase in the number of contact of the toner particles by agitation or the like) in a development device. Therefore, it has been problems that reproducibility of thin lines decreases and a deterioration in image quality due to fog or the like occurs, and adverse effect on printing durability is caused.

Accordingly, development of a toner is demanded, wherein, in the stage of initial printing, a suitable initial charging speed can be exhibited without being affected by the usage environment, and in the process of continuous printing of a large number of prints, defects such as burial and/or release of the particles of the external additive are unlikely to occur under the mechanical stress in the development device, the toner can maintain the state in which the particles of the external additive are suitably attached, and stable charging ability (charge stability) can be exhibited.

For example, Patent Literature 1 discloses a toner obtained by using highly-hydrophobic heat treated spherical sol-gel silica fine particles having an average primary particle diameter of 0.01 to 5 μm as an external additive, in which heat treated spherical sol-gel silica fine particles are hydrophobized with a silane compound, for the purpose of improving flowability of a toner, caking resistance, fixability, cleaning property and environmental stability of a charge amount.

Patent Literature 2 discloses a toner obtained by using surface modified silica fine powders as an external additive, in which silica fine powders are surface-treated with alkylalkoxysilane having an alkyl group being a hexyl group of 6 carbons, or an alkyl group of less than 6 carbons for the purpose of improving flowability and durability of a toner, and further improving cleaning property by inhibiting the generation of filming and fog.

Patent Literature 3 discloses a toner obtained by using fatty acid alkali metal salt particles or fatty acid alkaline earth metal salt particles having a number average primary particle diameter of 0.1 to 1 μm, and two kinds of silica particles each having a different particle diameter as external additives, for the purpose of having excellent charge stability of toners upon replenishment of toners and improving initial printing performance and printing durability.

CITATION LIST

Patent Literature

Patent Literature 1: Japanese Patent Application Laid-Open (JP-A) No. 2007-099582
Patent Literature 2: JP-A No. 2004-231498
Patent Literature 3: International Publication No. 2008-146881

SUMMARY OF INVENTION

Technical Problem

However, Patent Literatures 1 to 3 have not achieved development of the toner having the above-mentioned printing performance which is required in recent years.

The present invention has been made in view of the above circumstances, and it is an object of the present invention to provide a toner which can maintain a desired function of an external additive (a function to impart charge stability and flowability to the toner) under a severe usage environment such as high temperature and high humidity (H/H), which has an excellent initial charging speed, which has stable charging ability and flowability over time, which maintains reproducibility of thin lines and is unlikely to cause a deterioration in image quality due to fog or the like even after a large number of prints are continuously printed, and which has excellent printing durability.

Solution to Problem

In Patent Literature 1, printing durability under a severe environment such as high temperature and high humidity (H/H) has been studied; however, an initial charging speed in the stage of initial printing has not been studied.

In Patent Literature 2, printing performance under the normal temperature and normal humidity environment (N/N) has been studied; however, printing performance under the severe environment such as high temperature and high humidity (H/H) has not been studied.

In Patent Literature 3, initial printing performance and printing durability under the normal temperature and normal humidity environment (N/N) have been studied; however, printing performance under the severe environment such as high temperature and high humidity (H/H) has not been studied.

As a result of diligent researches of initial printing performance and printing durability under the severe usage environment such as high temperature and high humidity (H/H), which have not been sufficiently studied in Patent Literatures 1 to 3, in order to solve the above problems, the inventors of the present invention found out that by using the specific amounts of fatty acid metal salt particles and spherical colloidal silica particles having a specific particle diameter and being surface-treated with a specific silane compound as external additives, the external additives can maintain a desired function (a function to impart charge stability and flowability to the toner) under the severe usage environment such as high temperature and high humidity (H/H). Based on the above knowledge, the inventor has reached the present invention.

That is, the toner for developing electrostatic images of the present invention is a toner for developing electrostatic images comprising external additives, and colored resin particles comprising a binder resin and a colorant, wherein the external additives contain external additive A and external additive B, wherein external additive A is fatty acid metal salt particles, and a content of the fatty acid metal salt particles is in the range from 0.01 to 0.5 part by weight with respect to 100 parts by weight of the colored resin particles, and wherein external additive B is spherical colloidal silica particles having a number average primary particle diameter of 30 to 80 nm and being surface-treated with a silane compound having an alkyl group of 8 to 20 carbons, and a content of the spherical colloidal silica particles is in the range from 0.3 to 2.0 parts by weight with respect to 100 parts by weight of the colored resin particles.

In the toner for developing electrostatic images, it is preferable that the silane compound is an alkylalkoxysilane compound or an alkyl silane halide compound.

In the toner for developing electrostatic images, it is preferable that the toner for developing electrostatic images is a toner for developing electrostatic images, wherein the external additives further contain external additive C, and wherein the external additive C is fumed silica particles having a number average primary particle diameter of 5 to 25 nm, and a content of the fumed silica particles is in the range from 0.1 to 1.0 part by weight with respect to 100 parts by weight of the colored resin particles.

In the toner for developing electrostatic images, it is preferable that the spherical colloidal silica particles are further surface-treated with cyclic silazane.

In the toner for developing electrostatic images, it is preferable that the fumed silica particles are further surface-treated with cyclic silazane.

In the toner for developing electrostatic images, it is preferable that the colored resin particles have an average circularity of 0.975 or more.

In the toner for developing electrostatic images, it is preferable that the colored resin particles comprise a charge control agent, and the charge control agent is a charge control resin.

Advantageous Effects of Invention

According to the toner of the present invention, the toner which can maintain a desired function of an external additive (a function to impart charge stability and flowability to the toner) under a severe usage environment such as high temperature and high humidity (H/H), which has an excellent initial charging speed, which has stable charging ability and flowability over time, which maintains reproducibility of thin lines and is unlikely to cause a deterioration in image quality due to fog or the like even after a large number of prints are continuously printed, and which has excellent printing durability, can be provided.

DESCRIPTION OF EMBODIMENTS

The toner of the present invention is a toner for developing electrostatic images comprising external additives, and colored resin particles comprising a binder resin and a colorant, wherein the external additives contain external additive A and external additive B, wherein external additive A is fatty acid metal salt particles, and a content of the fatty acid metal salt particles is in the range from 0.01 to 0.5 part by weight with respect to 100 parts by weight of the colored resin particles, and wherein external additive B is spherical colloidal silica particles having a number average primary particle diameter of 30 to 80 nm and being surface-treated with a silane compound having an alkyl group of 8 to 20 carbons, and a content of the spherical colloidal silica particles is in the range from 0.3 to 2.0 parts by weight with respect to 100 parts by weight of the colored resin particles.

Hereinafter, the toner of the present invention will be described.

The toner of the present invention comprises colored resin particles comprising a binder resin and a colorant, fatty acid metal salt particles, and spherical colloidal silica particles having a specific particle diameter and being surface-treated with a specific silane compound.

The binder resin is not particularly limited as long as it is generally used as a binder resin for the toner. The examples include polystyrene, styrene-butyl acrylate copolymers, polyester resins and epoxy resins. These binder resins may be used alone or in combination of two or more kinds.

Generally, methods for producing the colored resin particles are broadly classified into dry methods such as a pulverization method and wet methods such as an emulsion polymerization agglomeration method, a dispersion polymerization method, a suspension polymerization method and a solution suspension method. The wet methods are preferable since toners having excellent printing performance such as the reproducibility of thin lines can be easily obtained. Among the wet methods, polymerization methods such as the emulsion polymerization agglomeration method, the dispersion polymerization method and the suspension polymerization method are preferable since toners which have relatively small particle size distribution in micron order can be easily obtained. Among the polymerization methods, the suspension polymerization method is more preferable.

The emulsion polymerization agglomeration method is a method for producing colored resin particles by polymerizing emulsified polymerizable monomers to obtain resin microparticles, and aggregating the resultant resin microparticles with a colorant etc. The solution suspension method is a method for producing colored resin particles by forming droplets of a solution in an aqueous medium, the solution in which toner components such as a binder resin and a colorant are dissolved or dispersed in an organic solvent, and removing the organic solvent. Both methods can be performed by known methods.

The colored resin particles of the present invention can be produced by employing the wet methods or the dry methods.

In the case of employing "(A) Suspension polymerization method" preferable among the wet methods or "(B) Pulverization method" typical among the dry methods, the following processes are performed.

(A) Suspension Polymerization Method (1) Preparation Process of Polymerizable Monomer Composition First, a polymerizable monomer, a colorant and other additives such as a charge control agent and a release agent, which are added if required, are mixed and dissolved or dispersed. Thereby, a polymerizable monomer composition is prepared. Upon preparing the polymerizable monomer composition, a media type dispersing machine is used, for example.

The polymerizable monomer means a monomer having a polymerizable functional group and the polymerizable monomer is polymerized to be a binder resin. As a main component of the polymerizable monomer, a monovinyl monomer is preferably used.

Examples of the monovinyl monomer include: styrene; styrene derivatives such as vinyl toluene and α-methylstyrene; acrylic acid and methacrylic acid; acrylic acid esters such as methyl acrylate, ethyl acrylate, propyl acrylate, butyl acrylate, 2-ethylhexyl acrylate and dimethylaminoethyl acrylate; methacrylic acid esters such as methyl methacrylate, ethyl methacrylate, propyl methacrylate, butyl methacrylate, 2-ethylhexyl methacrylate and dimethylaminoethyl methacrylate; acrylamide and methacrylamide; and olefins such as ethylene, propylene and butylene. These monovinyl monomers may be used alone or in combination of two or more kinds.

Among them, styrene, styrene derivatives, acrylic acid esters and methacrylic acid esters are particularly suitably used.

In order to improve the shelf stability of the toner (blocking resistance), as part of the polymerizable monomer, any crosslinkable polymerizable monomer can be used together with the monovinyl monomer. The crosslinkable polymerizable monomer means a monomer having two or more polymerizable functional groups.

The crosslinkable polymerizable monomer is not particularly limited as long as it is generally used as a crosslinkable polymerizable monomer for the toner. Examples of the crosslinkable polymerizable monomer include: aromatic divinyl compounds such as divinyl benzene, divinyl naphthalene and derivatives thereof; difunctional ethylenic unsaturated carboxylic acid esters such as ethylene glycol dimethacrylate and diethylene glycol dimethacrylate; heteroatom-containing divinyl compounds such as N,N-divinylaniline and divinyl ether; and compounds having three or more vinyl groups such as trimethylolpropane trimethacrylate and dimethylolpropane tetraacrylate. These crosslinkable polymerizable monomers may be used alone or in combination of two or more kinds.

In the present invention, it is desirable that the amount of the crosslinkable polymerizable monomer to be used is generally in the range from 0.1 to 5 parts by weight, preferably from 0.3 to 2 parts by weight, with respect to 100 parts by weight of the monovinyl monomer.

Further, as part of the polymerizable monomer, any macromonomer can be used together with the monovinyl monomer so that the balance of the shelf stability and low-temperature fixability of the toner can be improved.

The macromonomer is a reactive oligomer or polymer having a polymerizable carbon-carbon unsaturated bond at the end of a polymer chain and generally having a number average molecular weight (Mn) of 1,000 to 30,000. As the macromonomer, an oligomer or polymer having higher glass transition temperature (Tg) than that of a polymer (binder resin) obtained by polymerization of the polymerizable monomer is preferably used.

In the present invention, it is desirable that the amount of the macromonomer to be used is generally in the range from 0.01 to 10 parts by weight, preferably from 0.03 to 5 parts by weight, more preferably from 0.1 to 2 parts by weight, with respect to 100 parts by weight of the monovinyl monomer.

As the colorant, a color toner (four types of toners including a black toner, a cyan toner, a yellow toner and a magenta toner are generally used) is used. To produce the colored toner, a black colorant, a cyan colorant, a yellow colorant and a magenta colorant can be used.

Examples of the black colorant to be used include carbon black, titanium black, magnetic powder such as zinc-iron oxide and nickel-iron oxide.

Examples of the cyan colorant to be used include compounds such as copper phthalocyanine pigments, derivatives thereof and anthraquinone pigments. The specific examples include C. I. Pigment Blue 2, 3, 6, 15, 15:1, 15:2, 15:3, 15:4, 16, 17:1 and 60.

Examples of the yellow colorant to be used include compounds including azo pigments such as monoazo pigments and disazo pigments, and condensed polycyclic pigments. The specific examples include C. I. Pigment Yellow 3, 12, 13, 14, 15, 17, 62, 65, 73, 74, 83, 93, 97, 120, 138, 155, 180, 181, 185 and 186.

Examples of the magenta colorant to be used include compounds including azo pigments such as monoazo pigments and disazo pigments, and condensed polycyclic pigments. The specific examples include C. I. Pigment Red 31, 48, 57:1, 58, 60, 63, 64, 68, 81, 83, 87, 88, 89, 90, 112, 114, 122, 123, 144, 146, 149, 150, 163, 170, 184, 185, 187, 202, 206, 207, 209 and 251, and C. I. Pigment Violet 19.

These colorants can be used alone or in combination of two or more kinds.

In the present invention, it is desirable that the amount of the colorant to be used is in the range from 1 to 10 parts by weight, with respect to 100 parts by weight of the polymerizable monomer.

As one of other additives, a charge control agent having positively charging ability or negatively charging ability can be used to improve the charging ability of the toner.

The charge control agent is not particularly limited as long as it is generally used as a charge control agent for the toner. Among the charge control agents, a charge control resin having positively charging ability or negatively charging ability is preferably used since the charge control resin is highly compatible with the binder resin (or the polymerizable monomer) and can impart stable charging ability (charge stability) to the toner particles. From the viewpoint of obtaining a positively-chargeable toner, the charge control resin having positively charging ability is more preferably used.

As the charge control resins having positively charging ability, commercial products manufactured by Fujikura Kasei Co., Ltd. can be used. The examples include FCA-161P (product name; a styrene/acrylate resin), FCA-207P (product name; a styrene/acrylate resin), and FCA-201-PS (product name; a styrene/acrylate resin).

As the charge control resin having negatively charging ability, commercial products manufactured by Fujikura Kasei Co., Ltd. can be used. The examples include FCA-626N (product name; a styrene/acrylate resin), FCA-748N (product name; a styrene/acrylate resin), and FCA-1001N (product name; a styrene/acrylate resin).

In the present invention, it is desirable that the amount of the charge control agent to be used is generally in the range from 0.3 to 10 parts by weight, preferably from 0.5 to 8 parts by weight, with respect to 100 parts by weight of the polymerizable monomer.

As other additives, the release agent can be used to improve peelability from a fixing roller.

The release agent is not particularly limited as long as it is generally used as a release agent for the toner. The examples include: polyolefin waxes such as low-molecular-weight polyethylene, low-molecular-weight polypropylene and low-molecular-weight polybutylene; natural waxes such as candelilla, carnauba waxes, rice waxes, haze waxes and jojoba; petroleum waxes such as paraffin wax, microcrystalline and petrolactam; mineral waxes such as montan, ceresin and ozokerite; synthesized waxes such as Fischer-Tropsch waxes; and esterified compounds of polyalcohol including pentaerythritol ester such as pentaerythritol tetramyristate, pentaerythritol tetrapalmitate, pentaerythritol tetrastearate and pentaerythritol tetralaurate, dipentaerythritol ester such as dipentaerythritol hexamyristate, dipentaerythritol hexapalmitate and dipentaerythritol hexylaurate, and polyglyceryl fatty acid ester. These release agents may be used alone or in combination of two or more kinds.

In the present invention, it is desirable that the amount of the release agent to be used is generally in the range from 0.1 to 30 parts by weight, preferably from 1 to 20 parts by weight, with respect to 100 parts by weight of the polymerizable monomer.

As one of other additives, a molecular weight modifier can be used to control the molecular weight and molecular weight distribution of the binder resin.

The molecular weight modifier is not particularly limited as long as it is generally used as a molecular weight modifier for the toner. Examples of the molecular weight modifier include: mercaptans such as t-dodecyl mercaptan, n-dodecyl mercaptan, n-octyl mercaptan and 2,2,4,6,6-pentamethylheptane-4-thiol; and thiuram disulfides such as tetramethyl thiuram disulfide, tetraethyl thiuram disulfide, tetrabutyl thiuram disulfide, N,N'-dimethyl-N,N'-diphenyl thiuram disulfide and N,N'-dioctadecyl-N,N'-diisopropyl thiuram disulfide. These molecular weight modifiers may be used alone or in combination of two or more kinds.

In the present invention, it is desirable that the amount of the molecular weight modifier to be used is preferably in the range from 0.01 to 10 parts by weight, more preferably from 0.1 to 5 parts by weight, with respect to 100 parts by weight of the polymerizable monomer.

(2) Process of Obtaining Suspension (Droplets Forming Process)

The polymerizable monomer composition obtained by "(1) Preparation process of polymerizable monomer composition" is suspended in an aqueous dispersion medium to obtain a suspension (polymerizable monomer composition dispersion liquid). Herein, "suspension" means that droplets of the polymerizable monomer composition are formed in the aqueous dispersion medium. Dispersion treatment for forming the droplets can be performed by means of a device capable of strong stirring such as an in-line type emulsifying and dispersing machine (product name: EBARA MILDER; manufactured by: Ebara Corporation), and a high-speed emulsification dispersing machine (product name: T. K. HOMOMIXER MARK II; manufactured by; PRIMIX Corporation).

The aqueous dispersion medium may be water alone or any of water-soluble solvents such as lower alcohols and lower ketones can be used together with water.

A dispersion stabilizer is preferably added in the aqueous dispersion medium upon forming the droplets to improve control of particle diameters and circularity of the colored resin particle.

Examples of the dispersion stabilizer include: sulfates such as barium sulfate and calcium sulfate; carbonates such as barium carbonate, calcium carbonate and magnesium carbonate; phosphates such as calcium phosphate; metallic compounds including metallic oxides such as aluminum oxide and titanium oxide, and metallic hydroxides such as aluminum hydroxide, magnesium hydroxide and iron(II) hydroxide; water-soluble polymer compounds such as polyvinyl alcohol, methyl cellulose and gelatin; and organic polymer compounds such as anionic surfactants, nonionic surfactants and ampholytic surfactants.

Among the above dispersion stabilizers, dispersion stabilizers containing colloid of metallic compounds, particularly hardly water-soluble metal hydroxide, are preferable since the colored resin particles can have a small particle size distribution, so that the amount of the dispersion stabilizer remained after washing is small, thus the image can be clearly reproduced by the toner to be obtained, particularly the image quality under high temperature and high humidity cannot be deteriorated.

The above dispersion stabilizers can be used in combination of one or more kinds. The added amount of the dispersion stabilizer is preferably in the range from 0.1 to 20 parts by weight, more preferably from 0.2 to 10 parts by weight, with respect to 100 parts by weight of the polymerizable monomer.

Examples of a polymerization initiator which is used in the polymerization of the polymerizable monomer composition include: inorganic persulfates such as potassium persulfate and ammonium persulfate; azo compounds such as 4,4'-azobis(4-cyanovaleric acid), 2,2'-azobis(2-methyl-N-(2-hydroxyethyl)propionamide, 2,2'-azobis(2-amidinopropane) dihydrochloride, 2,2'-azobis(2,4-dimethylvaleronitrile) and 2,2'-azobisisobutyronitrile; and organic peroxides such as di-t-butylperoxide, benzoylperoxide, t-butylperoxy-2-ethylhexanoate, t-hexylperoxy-2-ethylhexanoate, t-butylperoxypyvalate, diisopropylperoxydicarbonate, di-t-butylperoxyisophthalate and t-butylperoxyisobutyrate. Among them, the organic peroxides are preferably used.

The polymerization initiator may be added after dispersing the polymerizable monomer composition to the aqueous dispersion medium containing the dispersion stabilizer and before forming droplets, or may be directly added to the polymerizable monomer composition.

The added amount of the polymerization initiator used for polymerization of the polymerizable monomer composition is preferably in the range from 0.1 to 20 parts by weight, more preferably from 0.3 to 15 parts by weight, further more preferably from 1.0 to 10 parts by weight, with respect to 100 parts by weight of the polymerizable monomer.

(3) Polymerization Process

The desirable suspension (the aqueous dispersion medium containing droplets of the polymerizable monomer composition) obtained in "(2) Process of obtaining suspension (droplets forming process)" is heated to polymerize. Thereby, an aqueous dispersion liquid of colored resin particles can be obtained.

In the present invention, the polymerization temperature is preferably 50° C. or more, more preferably in the range from 60 to 98° C. The polymerization time is preferably in the range from 1 to 20 hours, more preferably from 2 to 15 hours, in the present invention.

In order to polymerize droplets of the polymerizable monomer composition in a stably dispersed state, the polymerization reaction may proceed while agitating the droplets for dispersion treatment in the polymerization process continuously after "(2) Process of obtaining suspension (droplets forming process)".

The colored resin particles in the present invention may be colored resin particles having a core-shell structure (or "capsule type"), which are obtained by using the colored resin particles obtained by the polymerization process as a core layer and forming a shell layer, a material of which is different from that of the core layer, around the core layer.

The colored resin particles having the core-shell structure has a structure which covers the core layer including a substance having a low-softening point with the shell layer including a substance having a high-softening point, thereby taking a balance of lowering of fixing temperature and prevention of blocking at storage of the toner.

A method for producing the core-shell type colored resin particles mentioned above is not particularly limited, and can be produced by any conventional method. The in situ polymerization method and the phase separation method are preferable from the viewpoint of production efficiency.

A method for producing the core-shell type colored resin particles according to the in situ polymerization method will be hereinafter described.

A polymerizable monomer (a polymerizable monomer for shell) for forming a shell layer and a polymerization initiator for shell are added to the above-obtained aqueous dispersion liquid to which the colored resin particles are dispersed followed by polymerization, thus the core-shell type colored resin particles can be obtained.

As the polymerizable monomer for shell, the above-mentioned polymerizable monomer can be used. Among the polymerizable monomers, any of monomers which provide a polymer having Tg of more than 80° C. such as styrene and methyl methacrylate is preferably used alone or in combination of two or more kinds.

Examples of the polymerization initiator for shell used for polymerization of the polymerizable monomer for shell include: polymerization initiators including metal persulfates such as potassium persulfate and ammonium persulfate; and water-soluble azo compounds such as 2,2'-azobis-(2-methyl-N-(2-hydroxyethyl)propionamide) and 2,2'-azobis-(2-methyl-N-(1,1-bis(hydroxymethyl)-2-hydroxyethyl)propionamide).

The added amount of the polymerization initiator for shell used in the present invention is preferably the range from 0.1 to 30 parts by weight, more preferably from 1 to 20 parts by weight, with respect to 100 parts by weight of the polymerizable monomer for shell.

The polymerization temperature of the shell is preferably 50° C. or more, more preferably in the range from 60 to 95° C. The polymerization time of the shell is preferably in the range from 1 to 20 hours, more preferably from 2 to 15 hours.

(4) Processes of Separation, Washing, Filtering, Dehydrating and Drying

It is preferable that the aqueous dispersion liquid of the colored resin particles obtained after "(3) Polymerization process" is subjected to a series of operations including separation, washing, filtering, dehydrating, and drying several times as needed according to any conventional method.

First, in order to remove the dispersion stabilizer remained in the aqueous dispersion liquid of the colored resin particles, it is preferable to add acid or alkali to the aqueous dispersion liquid of the colored resin particles to wash.

If the dispersion stabilizer being used is an acid-soluble inorganic compound, acid is added to the aqueous dispersion liquid of the colored resin particles. On the other hand, if the dispersion stabilizer being used is an alkali-soluble inorganic compound, alkali is added to the aqueous dispersion liquid of the colored resin particles.

If the acid-soluble inorganic compound is used as the dispersion stabilizer, it is preferable to control pH of the aqueous dispersion liquid of the colored resin particles to 6.5 or less by adding acid. It is more preferable to control pH to 6 or less. Examples of the acid to be added include inorganic acids such as sulfuric acid, hydrochloric acid and nitric acid, and organic acids such as formic acid and acetic acid. Particularly, sulfuric acid is suitable for high removal efficiency of the dispersion stabilizer and small impact on production facilities.

(B) Pulverization Method

In the case of producing the colored resin particles by employing the pulverization method, the following processes are performed.

First, a binder resin, a colorant and other additives such as a charge control agent and a release agent, which are added if required, are mixed by means of a mixer such as a ball mill, a V type mixer, Henschel Mixer (product name (trade name); manufactured by MITSUI MINING COMPANY, LIMITED), a high-speed dissolver, an internal mixer or a whole burg internal mixer.

Next, the above-obtained mixture is kneaded while heating by means of a press kneader, a twin screw kneading machine or a roller. The obtained kneaded product is coarsely pulverized by means of a pulverizer such as a hammer mill, a cutter mill or a roller mill, followed by finely pulverizing by means of a pulverizer such as a jet mill or a high-speed rotary pulverizer, and classifying into desired particle diameters by means of a classifier such as a wind classifier or an airflow classifier. Thus, colored resin particles produced by the pulverization method can be obtained.

The binder resin, the colorant and other additives such as the charge control agent and the release agent, which are added if required, used in "(A) Suspension polymerization method" can be used in the pulverization method. Similarly as the colored resin particles obtained by "(A) Suspension polymerization method", the colored resin particles obtained by the pulverization method can also be in a form of the core-shell type colored resin particles produced by a method such as the in situ polymerization method.

(Colored Resin Particle)

The characteristics of the particle diameter of the colored resin particles obtained by "(A) Suspension polymerization method" or "(B) Pulverization method" will be hereinafter described.

Hereinafter, the colored resin particles include both core-shell type colored resin particles and colored resin particles which are not core-shell type.

The volume average particle diameter (Dv) of the colored resin particles is preferably in the range from 5 to 15 μm, more preferably from 6 to 12 μm, further more preferably from 7 to 10 μm, from the viewpoint of high-quality image forming.

If the volume average particle diameter (Dv) of the colored resin particles is less than the above lower limit, flowability of the toner lowers, a deterioration in image quality due to fog or the like is likely to occur, and adverse effect on printing performance may be caused. On the other hand, if the volume average particle diameter (Dv) of the colored resin particles exceeds the above upper limit, high-resolution images are difficult to be formed, so that the resolution of images to be obtained tends to decrease, and adverse effect on printing performance may be caused.

As for the colored resin particles, a particle size distribution (Dv/Dn), which is a ratio of the volume average particle diameter (Dv) and the number average particle size (Dn), is preferably in the range from 1.0 to 1.3, more preferably from 1.0 to 1.2, from the viewpoint of high-quality image forming.

If the particle size distribution (Dv/Dn) of the colored resin particles exceeds the above upper limit, flowability of the toner lowers, a deterioration in image quality due to fog or the like is likely to occur, and adverse effect on printing performance may be caused.

The value of the volume average particle diameter (Dv) and the number average particle size (Dn) of the colored resin particles can be measured by means of a particle diameter measuring device such as MULTISIZER (product name; manufactured by Beckman Coulter, Inc.).

The average circularity of the colored resin particles is preferably 0.975 or more, more preferably 0.980 or more, further more preferably 0.985 or more, from the viewpoint of high-quality image forming.

If the average circularity of the colored resin particles is less than the above lower limit, reproducibility of thin lines of a toner printing tends to decrease, and adverse effect on printing performance may be caused.

Herein, circularity is a value obtained by dividing a perimeter of a circle having an area same as a projected area of a particle by a perimeter of a projected particle image. Also, in the present invention, an average circularity is used as a simple method of quantitatively presenting shapes of particles and is an indicator showing the level of convexo-concave shapes of the colored resin particles. The average circularity is "1" when each of the colored resin particles is an absolute sphere, and the value becomes smaller as the shape of the surface of each of the colored resin particles becomes more complex. In order to obtain the average circularity (Ca), firstly, the circularity (Ci) of each of measured "n" particles of 0.4 μm or more by the diameter of an equivalent circle is calculated by the following Calculation formula 1. Next, the average circularity (Ca) is obtained by the following Calculation formula 2.

Circularity (Ci)=a perimeter of a circle having an area same as a projected area of a particle/a perimeter of a projected particle image — Calculation Formula 1

Calculation formula 2

$$Ca = \frac{\sum_{i=1}^{n} (Ci \times fi)}{\sum_{i=1}^{n} (fi)}$$

In Calculation formula 2, "fi" is the frequency of particles of circularity (Ci).

The above circularity and average circularity can be measured by means of any of flow particle image analyzers FPIA-2000, FPIA-2100 and FPIA-3000 (product name; manufactured by SYSMEX CORPORATION).

(5) External Addition Process

The colored resin particles obtained in "(A) Suspension polymerization method" or "(B) Pulverization method" are mixed and agitated together with external additive A and external additive B specified in the present invention, and the external additives are added to the colored resin particles. Thus, two kinds of the external additive particles can be uniformly and suitably attached (externally added) on the surface of the colored resin particles to form a one-component toner. The one-component toner may be mixed and agitated together with carrier particles to form a two-component developer.

The agitator for adding an external additive to colored resin particles is not particularly limited as long as it is an agitator capable of attaching the external additive on the surface of the colored resin particles. The examples include high speed agitators such as Henschel Mixer (product name; manufactured by MITSUI MINING COMPANY, LIMITED), SUPER MIXER (product name; manufactured by KAWATA MFG Co., Ltd.), Q MIXER (product name; manufactured by MITSUI MINING COMPANY, LIMITED), Mechanofusion system (product name; manufactured by Hosokawa Micron Corporation), MECHANOMILL (product name; manufactured by OKADA SEIKO CO., LTD.) and Nobilta (product name; manufactured by Hosokawa Micron Corporation).

In the present invention, several kinds of external additives including external additive A (fatty acid metal salt particles) and external additive B (spherical colloidal silica particles having a specific particle diameter and being surface-treated with a specific silane compound) are used by specific amounts.

Hereinafter, external additive A (fatty acid metal salt particles) and external additive B (spherical colloidal silica particles) will be described.

In the present invention, "fatty acid metal salt particles" used as external additive A mean salt particles containing "metal" and "higher fatty acid (R—COOH)" having an alkyl group (R—) of 11 to 30 carbons, preferably 12 to 24 carbons.

Specific examples of "metal" constituting the fatty acid metal salt particles used in the present invention include Li, Na, K, Rb, Cs, Be, Mg, Ca, Sr, Ba and Zn.

Among them, due to having low moisture absorptivity, divalent metals such as Mg, Ca and Zn are preferable, and Zn is more preferable.

Examples of "higher fatty acid (R—COOH)" constituting the fatty acid metal salt particles used in the present invention include: lauric acid ($CH_3(CH_2)_{10}COOH$), myristic acid ($CH_3(CH_2)_{12}COOH$), palmitic acid ($CH_3(CH_2)_{14}COOH$), stearic acid ($CH_3(CH_2)_{16}COOH$), arachidic acid ($CH_3(CH_2)_{18}COOH$), behenic acid ($CH_3(CH_2)_{20}COOH$), and lignoceric acid ($CH_3(CH_2)_{22}COOH$).

Among them, palmitic acid, stearic acid, arachidic acid and behenic acid are preferable, and stearic acid is more preferable.

Examples of the fatty acid metal salt particles used in the present invention include: fatty acid lithium such as lithium laurate, lithium myristate, lithium palmitate and lithium stearate; fatty acid sodium such as sodium laurate, sodium myristate, sodium palmitate and sodium stearate; fatty acid potassium such as potassium laurate, potassium myristate, potassium palmitate and potassium stearate; fatty acid magnesium such as magnesium laurate, magnesium myristate, magnesium palmitate and magnesium stearate; fatty acid calcium such as calcium laurate, calcium myristate, calcium palmitate and calcium stearate; and fatty acid zinc such as zinc laurate, zinc myristate, zinc palmitate and zinc stearate.

These fatty acid metal salt particles can be used alone or in combination of two or more kinds.

Among the fatty acid metal salt particles, fatty acid calcium, fatty acid magnesium and fatty acid zinc are preferably used, calcium stearate, magnesium stearate and zinc stearate are more preferably used, and zinc stearate is further more preferably used.

The number average primary particle diameter of the fatty acid metal salt particles used in the present invention is preferably in the range from 0.1 to 5 μm, more preferably from 0.2 to 3 μm, further more preferably from 0.3 to 2 μm.

If the number average primary particle diameter of the fatty acid metal salt particles is less than the lower limit, aggregation of the fatty acid metal salt particles and defect such as burial of the fatty acid metal salt particles to colored resin particles are likely to occur, and adverse effect on printing performance of the toner may be caused.

On the other hand, if the number average primary particle diameter of the fatty acid metal salt particles exceeds the upper limit, the fatty acid metal salt particles are easily released (detached) from the colored resin particles, so that a desired function of the external additive (a function to impart charge stability and flowability to the toner) cannot be imparted to the toner particles, and adverse effect on printing performance of the toner may be caused.

The content of the fatty acid metal salt particles used in the present invention is preferably in the range from 0.01 to 0.5 part by weight, more preferably from 0.03 to 0.3 part by weight, further more preferably from 0.05 to 0.2 part by weight, with respect to 100 parts by weight of the colored resin particles.

If the content of the fatty acid metal salt particles is less than the lower limit, a desired function of the external additive (a function to impart charge stability and flowability to the toner) cannot be obtained, and adverse effect on printing performance of the toner may be caused. On the other hand, if the content of the fatty acid metal salt particles exceeds the upper limit, an initial charging speed tends to decrease, stable charging ability and flowability cannot be imparted to the toner particles over time, and adverse effect on printing performance of the toner may be caused.

As the fatty acid metal salt particles used in the present invention, several kinds of commercial products can be used. Examples of the commercial products manufactured by Sakai Chemical Industry Co., Ltd. include SPL-100F (product name; lithium stearate; number average primary particle diameter: 0.7 μm), SPX-100F (product name; magnesium stearate; number average primary particle diameter: 1.0 μm), SPC-100F (product name; calcium stearate; number average primary particle diameter: 0.7 μm), and SPZ-100F (product name; zinc stearate; number average primary particle diameter: 0.5 μm).

In the present invention, external additive B (spherical colloidal silica particles having a specific particle diameter and being surface-treated with a specific silane compound) is used together with the above-mentioned external additive A (fatty acid metal salt particles) by specific amounts.

In the present invention, "spherical colloidal silica particles" used as external additive B mean colloidal silica particles having high sphericity and being surface-treated with a silane compound having an alkyl group of 8 to 20 carbons as a hydrophobicity-imparting treatment agent.

In addition, "colloidal silica particles" mean silica particles produced by the colloidal method.

In the present invention, by using the "spherical colloidal silica particles" which are surface-treated with the silane compound having the alkyl group of 8 to 20 carbons as external additive B, external additive B has optimum affinity with colored resin particles. Therefore, defects such as burial and/or release of external additive B are unlikely to occur, the state in which the particles of external additive B are uniformly and suitably attached on the surface of the colored resin particles can be maintained, and stable charging ability (charge stability) can be imparted to the toner particles.

Herein, "a silane compound having the alkyl group of 8 to 20 carbons" means a silane compound in which among four groups directly bond to a tetravalent silicon atom (Si) being a central element of the silane compound, at least one group is a linear or branched alkyl group ($R^1$) of 8 to 20 carbons, and can be represented by the following formula 1.

[Chemical formula 1]

$$R^1/(R^2)_nSi(X)_{3-n} \qquad \text{Formula 1}$$

In the above formula 1, $R^1$ is a group selected from the group consisting of linear and branched alkyl groups of 8 to 20 carbons; $R^2$ is a group selected from the group consisting of a hydrogen atom, a linear or branched alkyl group of 1 to 20 carbons and a phenyl group; X is a group selected from the group consisting of an alkoxy group, a halogen group and a linear or branched alkyl group of 1 to 6 carbons; and n is an integer of 0 to 3.

In the silane compound represented by the above formula 1 and specified in the present invention as the hydrophobicity-imparting treatment agent, $R^1$ is a linear or branched alkyl group of 8 to 20 carbons, preferably a linear or branched alkyl group of 8 to 18 carbons, more preferably a linear alkyl group of 8 to 18 carbons.

If the number of carbon atoms of $R^1$ is less than the lower limit, surface treatment of the spherical colloidal silica particles used as external additive B is not uniformly and suitably performed, a suitable initial charging speed cannot be obtained affected by the severe usage environment such as high temperature and high humidity (H/H), stable charging ability and flowability cannot be imparted to the toner particles over time, and adverse effect on printing performance of the toner may be caused.

On the other hand, the number of carbon atoms of $R^1$ exceeds the upper limit, reactivity of the surface treatment lowers, and hydrophobicity-imparting treatment may be insufficient.

Specific examples of the silane compound represented by the above formula 1 include an alkyl silane compound, an alkylalkoxysilane compound and an alkyl silane halide compound.

Examples of the alkyl silane compound include tetraoctylsilane, tetranonylsilane, tetradecylsilane, tetraundecylsilane, tetradodecylsilane, tetramidecylsilane, tetratetradecylsilane, tetrapentadecylsilane, tetrahexadecylsilane, tetraheptadecylsilane, tetraoctadecylsilane, tetranonadecylsilane and tetraeicosylsilane.

Examples of the alkylalkoxysilane include: monoalkyltrialkoxysilanes such as octyltriethoxysilane, nonyitriethoxysilane, decyltriethoxysilane, undecyltriethoxysilane, dodecyltriethoxysilane, tridecyltriethoxysilane, tetradecyltriethoxysilane, pentadecyltriethoxysilane, hexadecyltriethoxysilane, heptadecyltriethoxysilane, octadecyltriethoxysilane, nonadecyltriethoxysilane and eicosyltriethoxysilane; dialkyldialkoxysilanes such as dioctyldiethoxysilane, dinonyidiethoxysilane, didecyldiethoxysilane, diundecyldiethoxysilane, didodecyldiethoxysilane, ditridecyldiethoxysilane, ditetradecyldiethoxysilane, dipentadecyldiethoxysilane, dihexadecyldiethoxysilane, diheptadecyldiethoxysilane, dioctadecyldiethoxysilane, dinonadecyldiethoxysilane and dieicosyldiethoxysilane; and trialkylmonoalkoxysilanes such as trioctylethoxysilane, trinonylethoxysilane, tridecylethoxysilane, triundecylethoxysilane, tridodecylethoxysilane, tritridecylethoxysilane, tritetradecylethoxysilane, tripentadecylethoxysilane, trihexadecylethoxysilane, triheptadecylethoxysilane, trioctadecylethoxysilane, trinonadecylethoxysilane and trieicosylethoxysilane.

Examples of the alkyl silane halide compound include: alkyl silane chlorides such as dimethyloctylchlorosilane, dimethylnonylchlorosilane, dimethyldecylchlorosilane, dimethylundecylchlorosilane, dimethyldodecylchlorosilane, dimethyltridecylchlorosilane, dimethyltetradecylchlorosilane, dimethylpentadecylchlorosilane, dimethylhexadecylchlorosilane, dimethylheptadecylchlorosilane, dimethyloctadecylchlorosilane, dimethylnonadecylchlorosilane and dimethyleicosylchlorosilane; and alkyl silane bromides such as dimethyloctylbromosilane, dimethylnonylbromosilane, dimethyldecylbromosilane, dimethylundecylbromosilane, dimethyldodecylbromosilane, dimethyltridecylbromosilane, dimethyltetradecylbromosilane, dimethylpentadecylbromosilane, dimethylhexadecylbromosilane, dimethylheptadecylbromosilane, dimethyloctadecylbromosilane, dimethylnonadecylbromosilane and dimethyleicosylbromosilane.

These silane compounds can be used alone or in combination of two or more kinds.

Among the silane compounds, the alkylalkoxysilane compound and the alkyl silane halide compound are preferably used, monoalkyltrialkoxysilanes and alkyl silane chlorides are more preferably used, and octyltriethoxysilane, octadecyltriethoxysilane and dimethyloctadecylchlorosilane are further more preferably use.

In the present invention, the spherical colloidal silica particles are preferably surface-treated with the silane compound having the alkyl group of 8 to 20 carbons as the hydrophobicity-imparting treatment agent and further with chain silazane and/or cyclic silazane, since external additive B has optimum affinity with the colored resin particles, thus, the effect, in which the particles of external additive B are uniformly and suitably attached (externally added) on the surface of the colored resin particles, can be improved.

The chain silazane is not particularly limited as long as it is generally used as the hydrophobicity-imparting treatment agent. The example includes the chain silazane represented by the following formula 2.

Formula 2:

[Chemical formula 2]

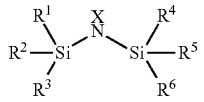

In the above formula 2, each of $R^1$ to $R^6$ is a group independently selected from the group consisting of a linear or branched alkyl group of 1 to 20 carbons, a hydrogen atom, an alkoxy group and a halogen group; X is a group selected from the group consisting of a linear or branched alkyl group of 1 to 20 carbons and hydrogen atom; and each of $R^1$ to $R^6$ may be identical.

Specific examples of the chain silazane represented by the above formula 2 include hexamethyldisilazane, hexaethyldisilazane, 1,3-dioctyl-1,1,3,3-tetramethyldisilazane, 1,1,3,3-tetramethyldisilazane, 1,3-bischloromethyl-1,1,3,3-tetramethyldisilazane and 1,3-divinyl-1,1,3,3-tetramethyldisilazane.

These chain silazanes can be used alone or in combination of two or more kinds.

Among the chain silazanes, hexamethyldisilazane and 1,3-dioctyl-1,1,3,3-tetramethyldisilazane are preferably used.

The cyclic silazane is not particularly limited as long as it is generally used as the hydrophobicity-imparting treatment agent. The example includes the cyclic silazane represented by the following formula 3.

Formula 3:

[Chemical formula 3]

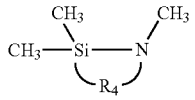

In the above formula 3, the silazane containing $R_4$ represented by the following formula 4 is preferably five-membered or six-membered cyclic silazane.

$$[(CH_2)_a(CHX)_b(CYZ)_c]$$ Formula 4 wherein, each of X, Y and Z is independently selected from the group consisting of hydrogen, halogen, alkyl, alkoxy, aryl and aryloxy; and a+b+c is 3 or 4.

Among the cyclic silazanes represented by the above formula 3, the cyclic silazane represented by the following formula 5, in which X is a methyl group, and Z are respectively hydrogen, and each of a, b and c is 1 in the above formula 4, is particularly preferably used.

Formula 5:

[Chemical formula 4]

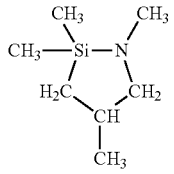

The sphericity of the spherical colloidal silica particles used in the present invention is preferably in the range from 1 to 1.5, more preferably from 1 to 1.2.

If the sphericity of the spherical colloidal silica particles exceeds the upper limit, an initial charging speed tends to decrease. In addition, charge amount distribution tends to be large, so that initial fog occurs and initial printing performance may be inferior, and stable charging ability and flowability cannot be sufficiently imparted to the toner particles over time, so that reproducibility of thin lines is difficult to be maintained and a deterioration in image quality due to fog or the like is likely to occur upon continuous printing of a large number of prints, and printing durability may be inferior. These tendencies occur very often under the severe usage environment such as high temperature and high humidity (H/H).

Herein, "sphericity" is a value obtained by dividing an area of circle (Sc) having a diameter being absolute maximum length of a particle by an actual projected area (Sr) of a particle.

The sphericity (Sc/Sr) of the colored resin particles is a value determined by: analyzing Sc and Sr of several particles by means of an image analyzing system using a photo of colored resin particles taken by an electron microscope to calculate sphericity (Sc/Sr); and calculating an arithmetic mean value.

The number average primary particle diameter of the spherical colloidal silica particles used in the present invention is in the range from 30 to 80 nm, preferably from 40 to 80 nm, more preferably from 45 to 75 nm.

If the number average primary particle diameter of the spherical colloidal silica particles is less than the lower limit, aggregation of the spherical colloidal silica particles and defect such as burial of the spherical colloidal silica particles to colored resin particles are likely to occur, and adverse effect on printing performance of the toner may be caused.

On the other hand, if the number average primary particle diameter of the spherical colloidal silica particles exceeds the upper limit, the spherical colloidal silica particles are easily released (detached) from colored resin particles, so that a desired function of the external additive (a function to impart charge stability and flowability to the toner) cannot be imparted to the toner particles, and adverse effect on printing performance of the toner may be caused.

In the present invention, the method for producing the spherical colloidal silica particles before surface treatment is not particularly limited, and a method generally used as the method for producing the spherical colloidal silica particles can be employed.

The specific method for obtaining spherical colloidal silica particles is as follows. For example, methanol, water and ammonia water are charged in a reactor, and the temperature of the mixed solution is adjusted to a predetermined temperature. Then, a material which is a mixture of tetramethoxysilane and tetrabutoxysilane is added dropwise in the reactor followed by adding ammonia water dropwise therein to perform the hydrolysis. Thus, a suspension of hydrophilic spherical colloidal silica particles is obtained. Next, methanol is removed from the obtained suspension, and water is added therein. Additionally, methanol is completely removed, thus an aqueous suspension is obtained. Next, methyltrimethoxysilane is added in the obtained aqueous suspension, and hydrophobicity-imparting treatment is performed followed by adding methyl isobutyl ketone therein to remove an azeotropic mixture. Then, methyl isobutyl ketone and methanol are removed from a residual liquid, in which methanol is added in the suspension and centrifugal separation is performed to remove a supernatant liquid, followed by drying. Thus, spherical colloidal silica particles are obtained.

In the present invention, the method of surface-treating the spherical colloidal silica particles is not particularly limited, and methods such as dry methods and wet methods generally used as the method for surface-treating the external additive can be employed.

As the surface treatment by the dry method, a method of surface treatment in which a hydrophobicity-imparting treatment agent is added dropwise or sprayed while agitating an external additive at high speed can be exemplified. Specific examples of the surface treatment by the wet method include a method of surface treatment in which an external additive is added while agitating an organic solvent in which a hydrophobicity-imparting treatment agent is dispersed, and a method of surface treatment in which a hydrophobicity-imparting treatment agent is added while agitating an organic solvent in which an external additive is dispersed.

A used amount of the silane compound having the alkyl group of 8 to 20 carbons and being specified in the present invention as the hydrophobicity-imparting treatment agent is preferably in the range from 1 to 30 parts by weight, more preferably from 3 to 20 parts by weight, further more preferably from 5 to 15 parts weight, with respect to 100 parts by weight of the spherical colloidal silica particles before surface treatment.

The content of the spherical colloidal silica particles used in the present invention is in the range from 0.3 to 2.0 parts by weight, preferably from 0.4 to 1.8 parts by weight, more preferably from 0.5 to 1.5 parts by weight, with respect to 100 parts by weight of the colored resin particles.

If the content of the spherical colloidal silica particles is less than the lower limit, a desired function of the external additive (a function to impart charge stability and flowability to the toner) cannot be exhibited, and adverse effect on printing performance of the toner may be caused. If the content of the spherical colloidal silica particles exceeds the upper limit, an initial charging speed is likely to decrease, stable charging ability and flowability cannot be imparted to the toner particles over time, and adverse effect on printing performance of the toner may be caused.

In the present invention, it is preferable to use fumed silica particles as external additive C together with the specific amounts of the above mentioned two kinds of additives including external additive A (fatty acid metal salt particles) and external additive B (spherical colloidal silica particles having a specific particle diameter and being surface-treated with a specific silane compound), since the effect of maintaining a desired function of the external additive (a function to impart charge stability and flowability to the toner) under the severe environment such as high temperature and high humidity (H/H) can be improved.

In the present invention, "fumed silica particles" used as external additive C mean silica particles produced by combustion method.

It is preferable to use the fumed silica particles (external additive C) which are surface-treated with the above-mentioned chain silazane and/or cyclic silazane as the hydrophobicity-imparting treatment agent, since external additive C has optimum affinity with the colored resin particles, thus, the effect in which the particles of external additive C are uniformly and suitably attached (externally added) on the surface of the colored resin particles can be improved.

The number average primary particle diameter of the fumed silica particles used in the present invention is preferably in the range from 5 to 25 nm, more preferably from 6 to 20 nm, further more preferably from 7 to 15 nm.

If the number average primary particle diameter of the fumed silica particles is less than the lower limit, aggregation of the fumed silica particles and defect such as burial of the fumed silica particles to colored resin particles are likely to occur, and adverse effect on printing performance of the toner may be caused.

If the number average primary particle diameter of the fumed silica particles exceeds the upper limit, the fumed silica particles are easily released (detached) from the colored resin particles and a ratio of the silica particles (coverage) to the surface of the colored resin particles declines, so that a desired function of the external additive (a function to impart charge stability and flowability to the toner) cannot be sufficiently imparted to the toner particles, and adverse effect on printing performance of the toner may be caused.

The content of the fumed silica particles used in the present invention is preferably in the range from 0.1 to 1.0 part by weight, more preferably from 0.15 to 0.9 part by weight, further more preferably from 0.2 to 0.7 part by weight, with respect to 100 parts by weight of the colored resin particles.

If the content of the fumed silica particles is less than the lower limit, a desired function of the external additive (a function to impart charge stability and flowability to the toner) cannot be exhibited, and adverse effect on printing performance of the toner may be caused. If the content of the fumed silica particles exceeds the upper limit, the fumed silica particles are easily released (detached) from the colored resin particles, so that a desired function of the external additive (a function to impart charge stability and flowability to the toner) cannot be sufficiently imparted to the toner particles, and adverse effect on printing performance of the toner may be caused.

As the fumed silica particles used in the present invention, several kinds of commercial products can be used. Examples of the commercial products include: TG-820F (product name; number average primary particle diameter: 7 nm) and TG-7120 (product name; number average primary particle diameter: 12 nm) manufactured by Cabot corporation; RA200 (product name; number average primary particle diameter: 12 nm) manufactured by Nippon Aerosil Co., Ltd.; and HDK2150 (product name; number average primary particle diameter: 12 nm) manufactured by Clariant (Japan) K.K.

In the steps of the present invention, the method for adding the above-mentioned external additive A (fatty acid metal salt particles), external additive B (spherical colloidal silica particles) and external additive C (fumed silica particles) to colored resin particles to mix and agitate is not particularly limited, and all kinds of the external additives can be added to the colored resin particles once to mix and agitate, for example. However, it is preferable that only external additive A having a relatively large particle diameter is firstly added to the colored resin particles to mix and agitate followed by adding external additive B having relatively small particle diameter to the colored resin particles to mix and agitate, and then external additive C having relatively further small particle diameter is added to the colored resin particles to mix and agitate.

(Toner)

The toner obtained as a result of the processes (1) to (5) uses the above-mentioned external additive A (fatty acid metal salt particles) and external additive B (spherical colloidal silica particles having a specific particle diameter and being surface-treated with a specific silane compound) as external additives by specific amounts, therefore, the toner can maintain a desired function of the external additive (a function to impart charge stability and flowability to the toner) under the severe usage environment such as high temperature and high humidity (H/H), has an excellent initial charging speed, has stable charging ability and flowability over time, maintains reproducibility of thin lines and is unlikely to cause a deterioration in image quality due to fog or the like even after a large number of prints are continuously printed, and has excellent printing durability.

EXAMPLES

Hereinafter, the present invention will be described further in detail with reference to examples and comparative examples. However, the scope of the present invention may not be limited to the following examples. Herein, "part(s)" and "%" are based on weight if not particularly mentioned.

Test methods used in the examples and the comparative examples are as follows.

(1) External Additive (1-1) Number Average Primary Particle Diameter

The number average primary particle diameter of an external additive was determined by: taking an electron micrograph of particles of the external additive; and calculating the arithmetic mean value of diameters of the equivalent circles corresponding to projected areas of the particles in the electron micrograph under the condition that the area ratio of particles to a frame area is up to 2% and the total number of analyzed particles is 100, by means of an image analyzing system (product name: LUZEX IID; manufactured by NIRECO CORPORATION).

(1-2) Sphericity

The sphericity of an external additive was determined by: taking a transmission electron micrograph of particles of the external additive; analyzing an area of circle (Sc) having a diameter being absolute maximum length of a particle in the electron micrograph and an actual projected area (Sr) of a particle; and calculating the arithmetic mean value of sphericity (Sc/Sr) under the condition that the area ratio of particles to a frame area is up to 2% and the total number of analyzed particles is 100, by means of an image analyzing system (product name: LUZEX IID; manufactured by NIRECO CORPORATION).

(2) Characteristics of Particle Diameter of Colored Resin Particles (2-1) Volume Average Particle Diameter (Dv), Number Average Particle Diameter (Dn) and Particle Size Distribution (Dv/Dn)

About 0.1 g of colored resin particles was weighed and charged into a beaker. Then, 0.1 ml of an aqueous solution of alkyl benzene sulfonate (product name: DRIWEL; manufactured by FUJIFILM Corporation) was added therein as a dispersant. Further, from 10 to 30 ml of an electrolyte solution for measurement (product name: ISOTON II-PC; manufactured by Beckman Coulter, Inc.) was added to the beaker. Thus prepared mixture was dispersed by means of an ultrasonic disperser at 20 W (watts) for 3 minutes. Then, the volume average particle diameter (Dv) and the number average particle diameter (Dn) of the colored resin particles were measured by means of a particle diameter measuring device (product name: MULTISIZER; manufactured by Beckman Coulter, Inc.) under the condition of an aperture diameter of 100 μm, using ISOTON II-PC as a medium, and a number of the measured particles of 100,000. Therefrom, the particle size distribution (Dv/Dn) was calculated.

(2-2) Average Circularity

Into a container pre-filled with ion-exchanged water of 10 ml, 0.02 g of a surfactant (alkyl benzene sulfonate) as a dispersant and 0.02 g of a colored resin particle were charged. Then, dispersion treatment was performed by means of an ultrasonic disperser at 60 W (watts) for 3 minutes. The concentration of colored resin particles was adjusted to be 3,000 to 10,000 particles/μL during measurement, and 1,000 to 10,000 colored resin particles having a diameter of 0.4 μm or more by a diameter of the equivalent circle were subjected to measurement by means of a flow particle image analyzer (product name: FPIA-2100; manufactured by SYSMEX CORPORATION). The average circularity was calculated from measured values thus obtained.

Circularity can be calculated by the following Calculation formula 1, and the average circularity is an average of the calculated circularities:

Circularity=a perimeter of a circle having an area same as a projected area of a particle/a perimeter of a projected image of a particle  Calculation formula 1

(3) Printing Characteristics of Toner (3-1) Initial Printing Test (Under H/H Environment)

A commercially available printer of the non-magnetic one-component developing method (printing speed: 20 prints in A4 size per minute) was used for an initial printing test. A toner was charged in a toner cartridge of a development device and printing paper was set in the printer.

After the printer was left under the high temperature and high humidity environment (H/H) having a temperature of 32° C. and a humidity of 80% for 24 hours, continuous printing with 5% image density was performed up to 100 prints under the H/H environment. Then, an initial fog value (%) was measured as follows.

After the continuous printing was performed up to 100 prints, a solid patterned image with 0% image density was printed with the printer followed by stopping the printer in mid-course of solid pattern printing, and then the toner remained in a non-image area on the photosensitive member after development was attached to an adhesive tape (product name: SCOTCH MENDING TAPE 810-3-18; manufactured by Sumitomo 3M Limited) and peeled. The adhesive tape was attached to a new printing paper to prepare a measurement sample, and the whiteness (B) of the measurement sample was measured by means of a whiteness colorimeter (product name: NDW-1D; manufactured by NIPPON DENSHOKU INDUSTRIES CO., LTD.).

Similarly, an unused tape was directly attached to a new printing paper to prepare a standard sample, and the whiteness (A) of the standard sample was measured.

The color difference ΔE (|A−B|) calculated by the whiteness (A) of the measurement sample and the whiteness (B) of the standard sample was referred to as an initial fog value ΔE. As the initial fog value decreases, it means that less fog is produced and image quality is excellent.

(3-2) Test of Reproducibility of Thin Lines (Under N/N Environment)

The above described printer was similarly used for a test of reproducibility of thin lines. A toner was charged in a toner cartridge of a development device and printing paper was set in the printer.

After the printer was left under the normal temperature and normal humidity environment (N/N) having a temperature of 23° C. and a humidity of 50% for 24 hours, line images with 2×2 dotline (width: about 85 μm) were continuously formed under the N/N environment, and continuous printing was performed up to 10,000 prints.

The concentration distribution data of the line images was collected every 500 prints by means of a printing evaluation system (product name: RT2000; manufactured by YA-MA, Inc.).

When defining the full width of an line image having a concentration being half value of the maximum concentration in the collected concentration distribution data of line images as a target line width, and using a line width formed on the printing paper which was firstly collected as a reference, the number of prints of continuous printing, which can maintain the difference between the target line width and the reference line width to be 10 μm or less, was counted.

In Table 1, "10,000<" means that the difference between the target line width and the reference line width can be maintained to 10 μm or less at the time of 10,000 prints.

(3-3) Printing Durability Test (Under N/N Environment and H/H Environment)

The above described printer was similarly used for a printing durability test. A toner was charged in a toner cartridge of a development device and printing paper was set in the printer.

After the printer was left under the normal temperature and normal humidity environment (N/N) having a temperature of 23° C. and a humidity of 50% for 24 hours, continuous printing with 5% image density was performed up to 10,000 prints under the N/N environment.

A solid patterned image with 100% image density was printed every 500 prints and the image density of the solid patterned image was measured by means of a reflection image densitometer (product name: RD918; manufactured by Gretag Macbeth Co.). Further, after a solid patterned image with 0% image density was printed with the printer followed by stopping the printer in mid-course of solid pattern printing, the toner remained in a non-image area on the photosensitive member after development was attached to an adhesive tape (product name: SCOTCH MENDING TAPE 810-3-18; manufactured by Sumitomo 3M Limited) and peeled. The tape was attached to a new printing paper.

Then, the whiteness (B) of the printing paper with the adhesive tape was measured by means of a whiteness colorimeter (product name: NDW-1D; manufactured by NIPPON DENSHOKU INDUSTRIES CO., LTD.). Similarly, an unused tape was attached to a printing paper to measure the whiteness (A). The difference of these whiteness (B−A) was referred to as a fog value ΔE. As the fog value decreases, it means that less fog is produced and image quality is excellent.

The number of prints by continuous printing which can maintain the image quality having an image density of 1.3 or more and a fog value ΔE of 3 or less was counted.

The similar printing durability test was performed under the high temperature and high humidity environment (H/H) having a temperature of 35° C. and a humidity of 80%.

In Table 1, "10,000<" means that the image quality having an image density of 1.3 or more and a fog value ΔE of 3 or less can be maintained at the time of 10,000 prints.

(Production of Spherical Colloidal Silica Particles)

Production Example 1

623.7 g of methanol, 41.4 g of water and 49.8 g of 28% ammonia water were charged in a 3 L glass reactor provided with an agitator, a dropping funnel and a thermometer, and mixed. The temperature of the mixed solution was adjusted to be 35° C.

While agitating the mixed solution in which the temperature was adjusted, a mixture of 1205.0 g of tetramethoxysilane and 100.6 g of tetrabutoxysilane, and 418.1 g of 5.4% ammonia water were gradually added to the mixed solution at the same time. The mixture of tetramethoxysilane and tetrabutoxysilane was added dropwise for 6 hours and the 5.4% ammonia water was added dropwise for 5 hours, respectively.

Even after finishing the dropping, the hydrolysis was performed by further continuing 0.5-hour agitation. Thus, a suspension of hydrophilic spherical colloidal silica particles was obtained.

Next, an ester adapter and a condenser were mounted on the 3 L glass reactor, and the temperature of the obtained suspension was raised up to 60 to 70° C. to remove (distill and remove) methanol. Then, water was added therein.

Additionally, the temperature of the suspension was raised up to 70 to 90° C. to remove (distill and remove) methanol. Thus, an aqueous suspension of hydrophilic spherical colloidal silica particles was obtained.

While agitating the obtained aqueous suspension of hydrophilic spherical colloidal silica particles, 11.6 g of methyltrimethoxysilane was gradually added in the aqueous suspension at room temperature dropwise for 0.5 hours. Even after finishing the dropping, hydrophobicity-imparting treatment was performed by further continuing 12-hour agitation.

1440 g of methyl isobutyl ketone was added in the suspension in which hydrophobicity-imparting treatment was performed. Then, the temperature of the aqueous suspension was raised up to 80 to 110° C. to remove (distill and remove) an azeotropic mixture for 10 hours followed by cooling to room temperature.

1000 g of methanol was added in the suspension obtained by distillation, and agitated for 10 minutes followed by being processed for 10 minutes at 3,000 G by means of a centrifuge to separate a supernatant liquid. Then, methyl isobutyl ketone and methanol were removed (distill and remove) from the residual liquid after removing the supernatant liquid followed by drying. Thus, spherical colloidal silica particles were obtained.

After 100 g of the spherical colloidal silica particles obtained by drying was dispersed in 300 ml of toluene, 10 g of octadecyltriethoxysilane (product name: LS-6970; manufactured by Shin-Etsu Chemical Co., Ltd.) represented by the following formula 6 being a silane compound, 10 g of cyclic silazane represented by the following formula 5, and 10 g of hexamethyldisilazane represented by the following formula 7 being chain silazane were added therein as hydrophobicity-imparting treatment agents at room temperature. Then, the obtained mixture was refluxed under heating for 3 hours and cooled to room temperature followed by separate spherical colloidal silica particles by suction filtration. Next, the separated spherical colloidal silica particles were dried for 2 hours at 50° C. by means of a vacuum drier, thereby producing spherical colloidal silica particles B1 of Production example 1. The characteristics of the obtained spherical colloidal silica particles B1 are shown in Tables 1, 2 and 3.

Formula 6:

[Chemical formula 5]

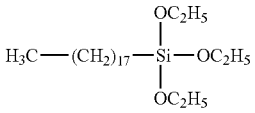

Formula 5:

[Chemical formula 6]

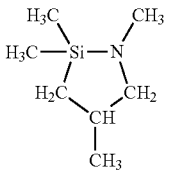

Formula 7:

[Chemical formula 7]

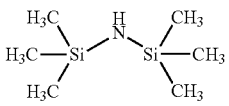

Production Example 2

Spherical colloidal silica particles B2 of Production example 2 were produced similarly as Production example 1 except that the kind of the silane compound used as the hydrophobicity-imparting treatment agent was changed from octadecyltriethoxysilane represented by the above formula 6 to n-octyltriethoxysilane (product name: Z-6341; manufactured by Dow Corning Toray Co., Ltd.) represented by the following formula 8. The characteristics of the obtained spherical colloidal silica particles B2 are shown in Table 1.

Formula 8

[Chemical formula 8]

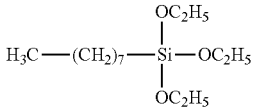

Production Example 3

Spherical colloidal silica particles B3 of Production example 3 were produced similarly as Production example 1 except that the kind of the silane compound used as the hydrophobicity-imparting treatment agent was changed from octadecyltriethoxysilane represented by the above formula 6 to dimethyloctadecylchlorosilane (product name: LS-6790; manufactured by Shin-Etsu Chemical Co., Ltd.) represented by the following formula 9, and 1.13 g of triethylamine represented by the following formula 10 was further added. The characteristics of the obtained spherical colloidal silica particles B3 are shown in Table 1.

Formula 9:

[Chemical formula 9]

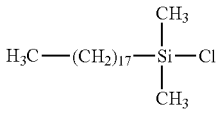

Formula 10:

[Chemical formula 10]

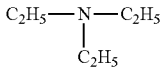

Production Example 4

Spherical colloidal silica particles B4 of Production example 4 were produced similarly as Production example 1 except that the kind of the silane compound used as the hydrophobicity-imparting treatment agent was changed from octadecyltriethoxysilane represented by the above formula 6 to n-propyltrimethoxysilane (product name: Z-6265; manufactured by Dow Corning Toray Co., Ltd.) represented by the following formula 11. The characteristics of the obtained spherical colloidal silica particles B4 are shown in Table 2.

Formula 11:

[Chemical formula 11]

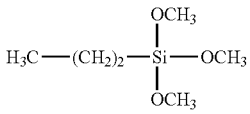

Production Example 5

Spherical colloidal silica particles B5 of Production example 5 were produced similarly as Production example 1 except that the silane compound used as the hydrophobicity-imparting treatment agent was not used, and the chain silazane used as the hydrophobicity-imparting treatment agent was changed from hexamethyldisilazane represented by the above formula 7 to 1,3-dioctyl-1,1,3,3-tetramethyldisilazane represented by the following formula 12. The characteristics of the obtained spherical colloidal silica particles B5 are shown in Table 3.

Formula 12:

[Chemical formula 12]

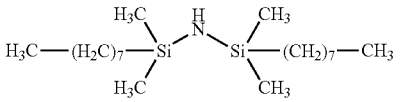

Example 1

83 parts of styrene and 17 parts of n-butyl acrylate as monovinyl monomers (calculated Tg of copolymer to be obtained=60° C.), 7 parts of carbon black (product name: #25B; manufactured by Mitsubishi Chemical Corporation) as a black colorant, 1 part of a charge control resin having positively charging ability (product name: FCA-207P; manufactured by Fujikura Kasei Co., Ltd.; a styrene/acrylate resin) as a charge control agent, 0.6 part of divinylbenzene as a crosslinkable polymerizable monomer, 1.9 parts of t-dodecyl mercaptan as a molecular weight modifier and 0.25 part of polymethacrylic acid ester macromonomer (product name: AA6; manufactured by Toagosei Co., Ltd.; Tg of copolymer to be obtained=94° C.) as a macromonomer were agitated by means of an agitator to mix followed by uniform dispersion by means of a media type dispersing machine. Thereto, 5 parts of dipentaerythritol hexamyristate as a release agent was added, mixed and dissolved. Thus, a polymerizable monomer composition was obtained.

Separately, in an agitating chamber, an aqueous solution of 6.2 parts of sodium hydroxide (alkali metal hydroxide) dissolved in 50 parts of ion-exchanged water was gradually added to an aqueous solution of 10.2 parts of magnesium chloride (water-soluble polyvalent metallic salt) dissolved in 250 parts of ion-exchanged water at room temperature while agitating to prepare a magnesium hydroxide colloid (hardly water-soluble metal hydroxide colloid) dispersion liquid.

The polymerizable monomer composition was charged into the above-obtained magnesium hydroxide colloid dispersion liquid and agitated at room temperature until the droplets were stable. Then, 6 parts of t-butylperoxy-2-ethylhexanoate (product name: PERBUTYL O; manufactured by NOF Corporation) as a polymerization initiator was added therein. The mixture was subjected to a high shear agitation at 15,000 rpm for 10 minutes by means of an in-line type emulsifying and dispersing machine (product name: EBARA MILDER; manufactured by Ebara Corporation). Thus, droplets of the polymerizable monomer composition were formed.

The suspension having the above-obtained droplets of the polymerization monomer composition dispersed (a polymerizable monomer composition dispersion liquid) was charged into a reactor furnished with an agitating blade and the temperature thereof was raised to 90° C. to start a polymerization reaction. When the polymerization conversion rate reached almost 100%, 1 part of methyl methacrylate as a polymerizable monomer for shell and 0.3 part of 2,2'-azobis (2-methyl-N-(2-hydroxyethyl)-propionamide) (product name: VA-086; manufactured by Wako Pure Chemical Industries, Ltd.; water-soluble) being a polymerization initiator for shell dissolved in 10 parts of ion-exchanged water were added in the reactor. After continuing the reaction for 4 hours at 90° C., the reactor was cooled by water to stop the reaction. Thus, an aqueous dispersion of colored resin particles was obtained.

The above-obtained aqueous dispersion of colored resin particles was subjected to acid washing in which sulfuric acid was added dropwise to be pH of 6.5 or less while agitating at room temperature. After separating by filtration, a solid content was obtained. The aqueous dispersion of colored resin particles was subjected to water washing treatment (washing, filtration and dehydration) several times in which another 500 parts of ion-exchanged water was added to the above-obtained solid content to make a slurry again. Next, separation by filtration was performed and the thus obtained solid content was charged into a container of a dryer for drying at 45° C. for 48 hours. Thus, dried colored resin particles were obtained.

The volume average particle diameter "Dv" of the colored resin particles obtained was 9.7 μm, and the particle size distribution "Dv/Dn" was 1.14. The average circularity was 0.987.

To 100 parts of the above-obtained colored resin particles, 0.08 part of zinc stearate particles (product name: SPZ-100F; manufactured by: Sakai Chemical industry Co., Ltd.; number average primary particle diameter: 0.5 μm) being fatty acid metal salt particles as external additive A, 1.2 parts of spherical colloidal silica particles B1 of Production example 1 as external additive B, and 0.4 part of fumed silica particles (product name: TG-820F; manufactured by Cabot corporation; the number average primary particle diameter: 7 nm) which are surface-treated with the cyclic silazane represented by the above formula 5 as external additive C were added to mix and agitate by means of a high speed agitator (product name: Henschel Mixer; manufactured by MITSUI MINING COMPANY, LIMITED) at a peripheral speed of 30 m/s for 6 minutes, and the external additives were externally added. Thus, a toner of Example 1 was produced, and used for tests. The evaluation result of the obtained toner is shown in Table 1.

Example 2

A toner of Example 2 was produced similarly as Example 1 except that the added amount of the fatty acid metal salt particles being external additive A was changed from 0.08 part to 0.2 part, the kind of the spherical colloidal silica particles being external additive B was changed from spherical colloidal silica particles B1 of Production example 1 to spherical colloidal silica particles B2 of Production example 2, and the added amount of the spherical colloidal silica particles being external additive B was changed from 1.2 parts to 0.8 part, and the toner of Example 2 was used for tests. The evaluation result of the obtained toner is shown in Table 1.

Example 3

A toner of Example 3 was produced similarly as Example 1 except that the added amount of the fatty acid metal salt particles being external additive A was changed from 0.08 part to 0.15 part, the kind of the spherical colloidal silica particles being external additive B was changed from spherical colloidal silica particles B1 of Production example 1 to spherical colloidal silica particles B3 of Production example 3, and the added amount of the spherical colloidal silica particles being external additive B was changed from 1.2 parts to 1.6 parts, and the toner of Example 3 was used for tests. The evaluation result of the obtained toner is shown in Table 1.

Example 4

A toner of Example 4 was produced similarly as Example 1 except that the kind of the fatty acid metal salt particles being external additive A was changed from the zinc stearate particles to magnesium stearate particles (product name: SPX-100F; manufactured by Sakai Chemical Industry Co., Ltd.; number average primary particle diameter: 1.0 μm), and was used for tests. The evaluation result of the obtained toner is shown in Table 2.

Example 5

A toner of Example 5 was produced similarly as Example 1 except that the kind of the fatty acid metal salt particles being external additive A was changed from the zinc stearate particles to calcium stearate particles (product name: SPC-100F; manufactured by Sakai Chemical Industry Co., Ltd.; number average primary particle diameter: 0.7 μm), and was used for tests. The evaluation result of the obtained toner is shown in Table 2.

Comparative Example 1

A toner of Comparative example 1 was produced similarly as Example 1 except that the kind of the spherical colloidal silica particles being external additive B was changed from spherical colloidal silica particles B1 of Production example 1 to spherical colloidal silica particles B4 of Production example 4, and was used for tests. The evaluation result of the obtained toner is shown in Table 2.

Comparative Example 2

A toner of Comparative example 2 was produced similarly as Example 1 except that the spherical colloidal silica particles being external additive B were not added, and was used for tests. The evaluation result of the obtained toner is shown in Table 3.

Comparative Example 3

A toner of Comparative example 3 was produced similarly as Example 1 except that the kind of the spherical colloidal silica particles being external additive B was changed from spherical colloidal silica particles B1 of Production example 1 to spherical colloidal silica particles B5 of Production example 5, and was used for tests. The evaluation result of the obtained toner is shown in Table 3.

Comparative Example 4

A toner of Comparative example 4 was produced similarly as Example 1 except that the fatty acid metal salt particles being external additive A were not added, and was used for tests. The evaluation result of the obtained toner is shown in Table 3.

TABLE 1

| | | | Example 1 | Example 2 | Example 3 |
|---|---|---|---|---|---|
| | | | (External additive A) | | |
| Fatty acid metal salt particles | Type | | Zinc stearate particles | Zinc stearate particles | Zinc stearate particles |
| | Number average primary particle diameter (μm) | | 0.5 | 0.5 | 0.5 |
| | Added amount (part) | | 0.08 | 0.2 | 0.15 |
| | | | (External additive B) | | |
| Spherical colloidal silica particles | Type | | Spherical colloidal silica particles B1 of Production example 1 | Spherical colloidal silica particles B2 of Production example 2 | Spherical colloidal silica particles B3 of Production example 3 |
| | Type of hydrophobicity-imparting treatment agent | Silane compound | Octadecyltriethoxysilane | n-octyltriethoxysilane | Dimethyloctadecylchlorosilane |
| | | Cyclic silazane | Cyclic silazane of formula 5 | Cyclic silazane of formula 5 | Cyclic silazane of formula 5 |
| | | Chain silazane | Hexamethyldisilazane | Hexamethyldisilazane | Hexamethyldisilazane |
| | Number average primary particle diameter (nm) | | 70 | 70 | 70 |
| | Sphericity | | 1.14 | 1.14 | 1.14 |
| | Added amount (part) | | 1.2 | 0.8 | 1.6 |
| | | | (External additive C) | | |
| Fumed silica particles | Product name (manufacturer) | | TG-820F (Cabot corporation) | TG-820F (Cabot corporation) | TG-820F (Cabot corporation) |
| | Type of hydrophobicity-imparting treatment agent | | Cyclic silazane of formula 5 | Cyclic silazane of formula 5 | Cyclic silazane of formula 5 |
| | Number average primary particle diameter (nm) | | 7 | 7 | 7 |
| | Added amount (part) | | 0.4 | 0.4 | 0.4 |
| | | | (Printing characteristics of toner) | | |
| Initial fog value ΔE (H/H) | | | 0.5 | 0.7 | 1.0 |
| Reproducibility of thin lines (prints) (N/N) | | | 10,000< | 10,000< | 10,000< |
| Printing durability (prints) (N/N) | | | 10,000< | 10,000< | 10,000< |
| Printing durability (prints) (H/H) | | | 7,500 | 7,000 | 7,500 |

TABLE 2

| | | Example 4 | Example 5 | Comparative example 1 |
|---|---|---|---|---|
| | | (External additive A) | | |
| Fatty acid metal salt particles | Type | Magnesium stearate particles | Calcium stearate particles | Zinc stearate particles |
| | Number average primary particle diameter (μm) | 1.0 | 0.7 | 0.5 |
| | Added amount (part) | 0.08 | 0.08 | 0.08 |
| | | (External additive B) | | |
| Spherical colloidal silica particles | Type | Spherical colloidal silica particles B1 of Production example 1 | Spherical colloidal silica particles B1 of Production example 1 | Spherical colloidal silica particles B4 of Production example 4 |
| | Type of hydrophobicity-imparting treatment agent: Silane compound | Octadecyltriethoxysilane | Octadecyltriethoxysilane | n-propyltrimethoxysilane |
| | Type of hydrophobicity-imparting treatment agent: Cyclic silazane | Cyclic silazane of formula 5 | Cyclic silazane of formula 5 | Cyclic silazane of formula 5 |
| | Type of hydrophobicity-imparting treatment agent: Chain silazane | Hexamethyldisilazane | Hexamethyldisilazane | Hexamethyldisilazane |
| | Number average primary particle diameter (nm) | 70 | 70 | 70 |
| | Sphericity | 1.14 | 1.14 | 1.14 |
| | Added amount (part) | 1.2 | 1.2 | 1.2 |
| | | (External additive C) | | |
| Fumed silica particles | Product name (manufacturer) | TG-820F (Cabot corporation) | TG-820F (Cabot corporation) | TG-820F (Cabot corporation) |
| | Type of hydrophobicity-imparting treatment agent | Cyclic silazane of formula 5 | Cyclic silazane of formula 5 | Cyclic silazane of formula 5 |
| | Number average primary particle diameter (nm) | 7 | 7 | 7 |
| | Added amount (part) | 0.4 | 0.4 | 0.4 |
| | | (Printing characteristics of toner) | | |
| Initial fog value ΔE (H/H) | | 1.0 | 1.2 | 2.2 |
| Reproducibility of thin lines (prints) (N/N) | | 10,000< | 10,000< | 10,000< |
| Printing durability (prints) (N/N) | | 10,000< | 10,000< | 10,000< |
| Printing durability (prints) (H/H) | | 7,000 | 7,000 | 6,000 |

TABLE 3

| | | Comparative example 2 | Comparative example 3 | Comparative example 4 |
|---|---|---|---|---|
| | | (External additive A) | | |
| Fatty acid metal salt particles | Type | Zinc stearate particles | Zinc stearate particles | — |
| | Number average primary particle diameter (μm) | 0.5 | 0.5 | — |
| | Added amount (part) | 0.08 | 0.08 | — |
| | | (External additive B) | | |
| Spherical colloidal silica particles | Type | — | Spherical colloidal silica particles B5 of Production example 5 | Spherical colloidal silica particles B1 of Production example 1 |
| | Type of hydrophobicity-imparting treatment agent: Silane compound | — | — | Octadecyltriethoxysilane |
| | Type of hydrophobicity-imparting treatment agent: Cyclic silazane | — | Cyclic silazane of formula 5 | Cyclic silazane of formula 5 |
| | Type of hydrophobicity-imparting treatment agent: Chain silazane | — | 1,3-dioctyl-1,1,3,3-tetramethyldisilazane | Hexamethyldisilazane |
| | Number average primary particle diameter (nm) | — | 70 | 70 |
| | Sphericity | — | 1.14 | 1.14 |
| | Added amount (part) | — | 1.2 | 1.2 |
| | | (External additive C) | | |
| Fumed silica particles | Product name (manufacturer) | TG-820F (Cabot corporation) | TG-820F (Cabot corporation) | TG-820F (Cabot corporation) |
| | Type of hydrophobicity-imparting treatment agent | Cyclic silazane of formula 5 | Cyclic silazane of formula 5 | Cyclic silazane of formula 5 |
| | Number average primary particle diameter (nm) | 7 | 7 | 7 |
| | Added amount (part) | 0.4 | 0.4 | 0.4 |
| | | (Printing characteristics of toner) | | |
| Initial fog value ΔE (H/H) | | 3.7 | 3.5 | 4.0 |
| Reproducibility of thin lines (prints) (N/N) | | 9,000 | 6,500 | 10,000< |
| Printing durability (prints) (N/N) | | 8,500 | 8,500 | 7,500 |
| Printing durability (prints) (H/H) | | 5,500 | 5,500 | 3,500 |

Summary of Results

From the evaluation results shown in Tables 1, 2 and 3, the following are understood.

In the toner of Comparative example 1, reproducibility of thin lines and printing durability under the N/N environment were relatively excellent; however, initial fog under the H/H environment was likely to occur, and printing durability under the H/H environment was inferior, since the toner of Comparative example 1 used the spherical colloidal silica particles as external additive B, which were surface-treated with the silane compound not specified in the present invention as the hydrophobicity-imparting treatment agent.

In the toner of Comparative example 2, reproducibility of thin lines and printing durability under the N/N environment were relatively excellent; however, initial fog under the H/H environment was more likely to occur and printing durability under the H/H environment was inferior, compared to the result of Comparative example 1, since the toner of Comparative example 2 did not use the spherical colloidal silica particles specified in the present invention as external additive B.

In the toner of Comparative example 3, printing durability under the N/N environment was relatively excellent; however, initial fog under the H/H environment was likely to occur, reproducibility of thin lines was difficult to be maintained, and printing durability under the H/H environment was inferior, since the toner of Comparative example 3 used the spherical colloidal silica particles as external additive B, which were surface-treated without the silane compound specified in the present invention as the hydrophobicity-imparting treatment agent.

In the toner of Comparative example 4, reproducibility of thin lines was excellent; however, initial fog under the H/H environment was likely to occur, and printing durability under each of the N/N and H/H environments was inferior, since the toner of Comparative example 4 did not use the fatty acid metal salt particles specified in the present invention as external additive A.

To the contrary, in the toners of Examples 1 to 5, initial fog under the H/H environment was unlikely to occur, reproducibility of thin lines was maintained, a deterioration in image quality due to fog or the like was unlikely to occur even under the H/H environment, and initial printing performance and printing durability were excellent, since the toners of Examples 1 to 5 used the specific amounts of external additive A (fatty acid metal salt particles) and external additive B (spherical colloidal silica particles having a specific particle diameter and being surface-treated with a specific silane compound) specified in the present invention.

The invention claimed is:

1. A toner for developing electrostatic images, comprising external additives, and colored resin particles comprising a binder resin and a colorant, wherein the external additives contain external additive A and external additive B, wherein external additive A is fatty acid metal salt particles, and a content of the fatty acid metal salt particles is in the range from 0.01 to 0.5 part by weight with respect to 100 parts by weight of the colored resin particles, and wherein external additive B is spherical colloidal silica particles having a number average primary particle diameter of 30 to 80 nm and being surface-treated with a silane compound having an alkyl group of 8 to 20 carbons, and a content of the spherical colloidal silica particles is in the range from 0.3 to 2.0 parts by weight with respect to 100 parts by weight of the colored resin particles.

2. The toner for developing electrostatic images according to claim 1, wherein the silane compound is an alkylalkoxysilane compound or an alkyl silane halide compound.

3. The toner for developing electrostatic images according to claim 1, wherein the external additives further contain external additive C, and wherein the external additive C is fumed silica particles having a number average primary particle diameter of 5 to 25 nm, and a content of the fumed silica particles is in the range from 0.1 to 1.0 part by weight with respect to 100 parts by weight of the colored resin particles.

4. The toner for developing electrostatic images according to claim 3, wherein the fumed silica particles are further surface-treated with cyclic silazane.

5. The toner for developing electrostatic image according to claim 1, wherein the spherical colloidal silica particles are further surface-treated with cyclic silazane.

6. The toner for developing electrostatic images according to claim 1, wherein the colored resin particles have an average circularity of 0.975 or more.

7. The toner for developing electrostatic images according to claim 1, wherein the colored resin particles comprise a charge control agent, and the charge control agent is a charge control resin.

* * * * *